US005725126A

United States Patent [19]

Poissant

[11] Patent Number: 5,725,126

[45] Date of Patent: Mar. 10, 1998

[54] PUMP SYSTEM FOR TRANSPORTING LIQUID SMOKE FOR MODEL RAILROADS

[75] Inventor: Matthew N. Poissant, Portsmouth, Va.

[73] Assignee: Samsung Electronics Co., Ltd., Suwon, Rep. of Korea

[21] Appl. No.: 406,377

[22] Filed: Mar. 17, 1995

[51] Int. Cl.[6] ..... G01F 11/00

[52] U.S. Cl. ..... 222/78; 222/333; 446/24

[58] Field of Search ..... 222/78, 333; 446/24

[56] References Cited

U.S. PATENT DOCUMENTS

| | | | |
|---|---|---|---|
| 3,190,502 | 6/1965 | Knibb | 222/333 X |
| 3,272,510 | 9/1966 | Ohlund et al. | 446/24 X |
| 4,303,397 | 12/1981 | Swiatosz | 446/24 X |
| 4,456,149 | 6/1984 | Sciortino | 222/333 X |
| 4,741,717 | 5/1988 | Wolf | 446/24 |
| 5,370,278 | 12/1994 | Raynie | 222/333 X |

FOREIGN PATENT DOCUMENTS

| | | | |
|---|---|---|---|
| 458202 | 12/1936 | United Kingdom | 222/333 |

*Primary Examiner*—Joseph Kaufman
*Attorney, Agent, or Firm*—Cushman Darby & Cushman, IP Group of Pillsbury Madison & Sutro LLP

[57] ABSTRACT

This pump system is for model railroading enthusiasts that can be easily installed into any type of structure for model railroading. The pump system is a system for transporting liquid smoke for all scales in model railroading. This pump system will enhance the realism of the model railroad layout. The purpose of this system is to eliminate the manual application of applying liquid smoke to an engine's smoke stack or structure that requires liquid smoke.

1 Claim, 4 Drawing Sheets

"PRIOR ART"

PUMP SYSTEM FOR TRANSPORTING LIQUID SMOKE FOR MODEL RAILROADS

REFERENCES CITED

U.S. Patent Documents

U.S. Pat No. 5,158,210, filed Jan. 30, 1994: Benjamin R. Du 222/401

OBJECTS OF THE INVENTION

Figure 1:
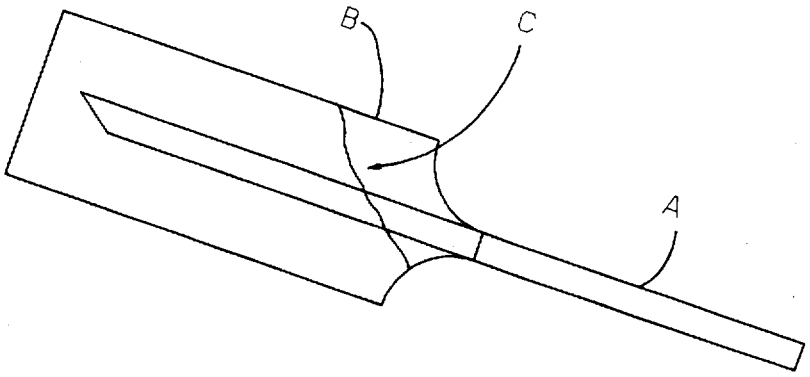
FIG. 1 is a drawing of a plastic tube full of liquid smoke (oil) and a needle for applying liquid smoke manually currently used in model railroading.

1. direct current power source
2*a*. wire
2*b*. wire
2*c*. wire
3. electrical push button assembly
4. reservoir
5*a*. hose
5*b*. hose
6. connector
7. electrical piston pump assembly
8*a*. hose
8*b*. hose
9. connector
10. hollow metal tube

DETAILED DESCRIPTION OF THE DRAWINGS

In FIG. 1, currently used in model railroading is a plastic tube B filled with liquid smoke C and a hollow needle A. The tube B is filled with liquid smoke C and the needle A is punctured into the tube B. This is the only known applicator used for applying liquid smoke.

Figure 2:
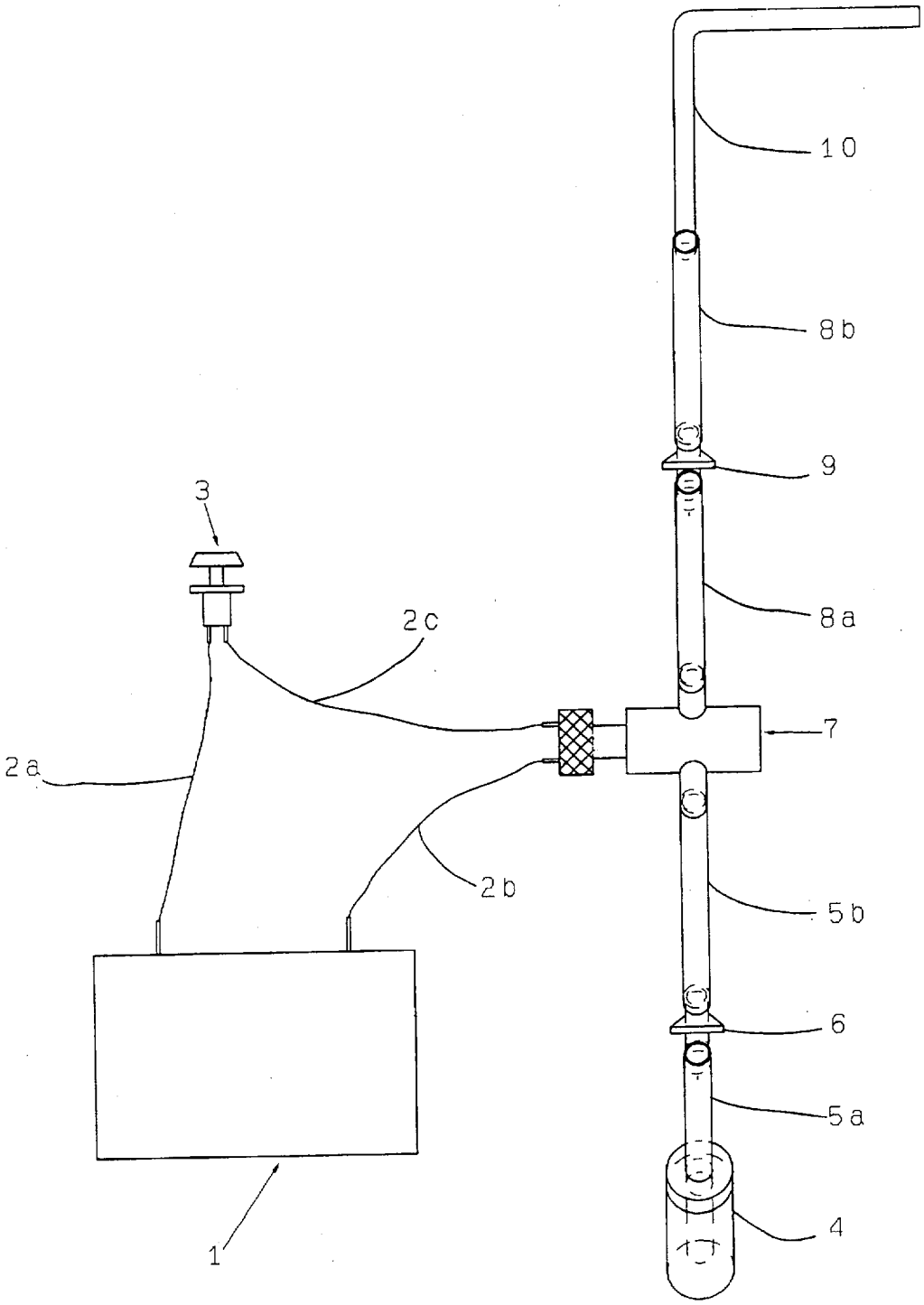
FIG. 2 is the assembly drawing of the pump system and all the components

In FIG. 2, shows every part assembled in the pump system. A power source 1 is for direct current. Electrical wire 2*a* is connected to one of the terminals of the power source and to the terminal of the push button assembly 3. Electrical wire 2*b* is connected to one terminal of the electrical piston pump assembly 7 and to the other terminal on the power source 1. Electrical wire 2*c* is connected to the other terminal on the pump assembly 7 and the other terminal of the push button 3. A reservoir 4 is for storing the liquid smoke and securing the hose 5*a*. A connector 6 is for joining hose 5*a* to hose 5*b* to transport the liquid smoke on the suction side of the pump assembly 7. A pump assembly 7 is the actual electrical/mechanical mechanism for distributing the liquid smoke. A hose 8*a* is connected from the pressure side of the pump assembly 7. A connector 9 is for joining hose 8*a* and 8*b* to the hollow metal tube 10 which is a rigid spout to dispense the liquid smoke.

Figure 3:
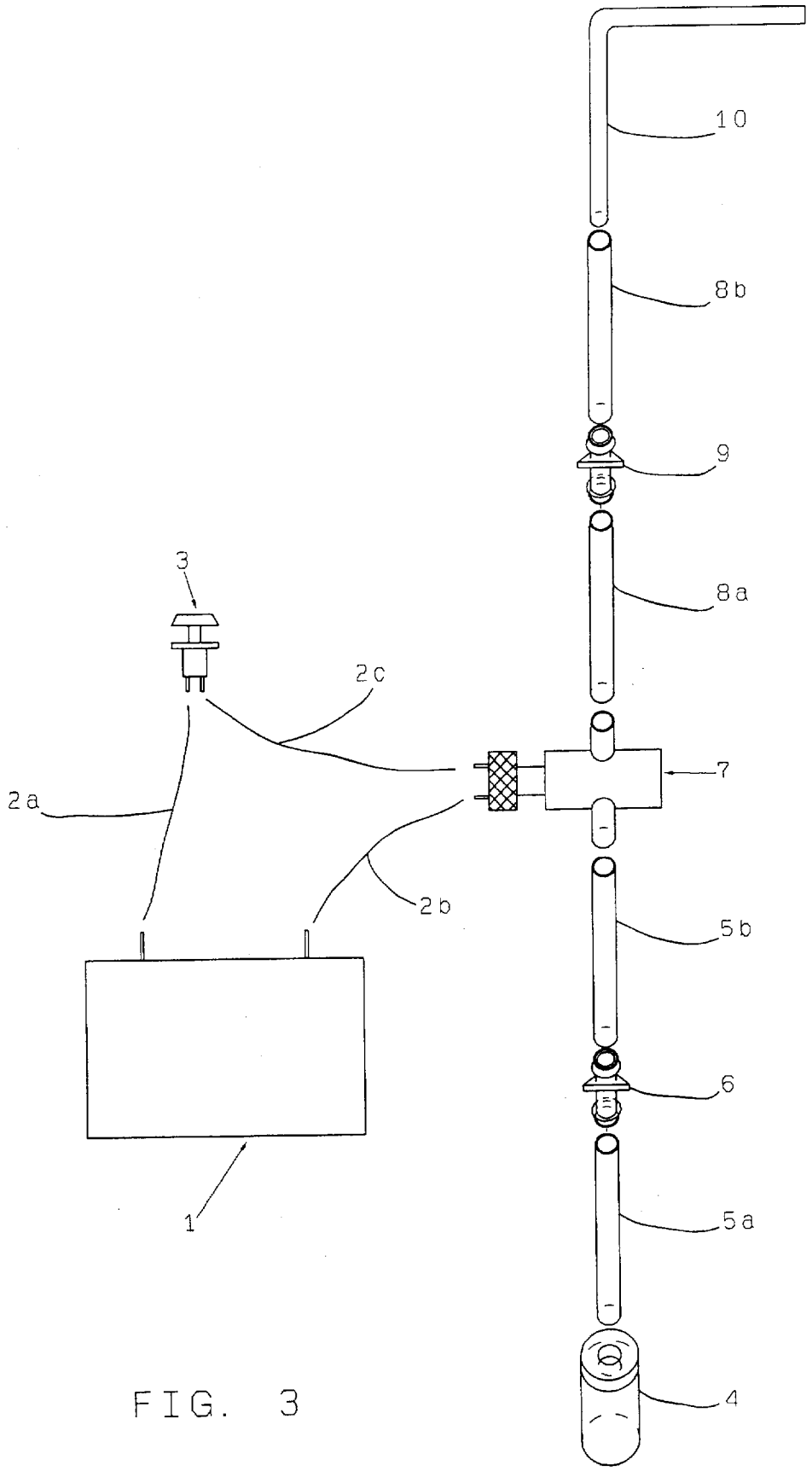
FIG. 3 is the pump system as an assembly.

In FIG. 3, each individual part is set as an assembly. A direct current power source 1 is for supplying DC current. Wife's 2*a*, 2*b*, and 2*c* are for carrying the electric current from the power source 1 to a electrical push button 3 and the electrical piston pump assembly 7. A reservoir 4 is for storing liquid smoke and securing tube 5*a* in the middle of the reservoir. A tube 5*a* is the suction side of the pump. A Connector 6 is a plastic connector for joining tube 5*a* and 5*b*. A electrical piston pump assembly 7 is for providing suction and pressure. A tube 8*a* is located on the pressure side of the pump. A connector 9 is a plastic connector for joining tube 8*a* and 8*b*. A hollow metal tube 10 is the spout for dispensing the liquid smoke.

Figure 4:
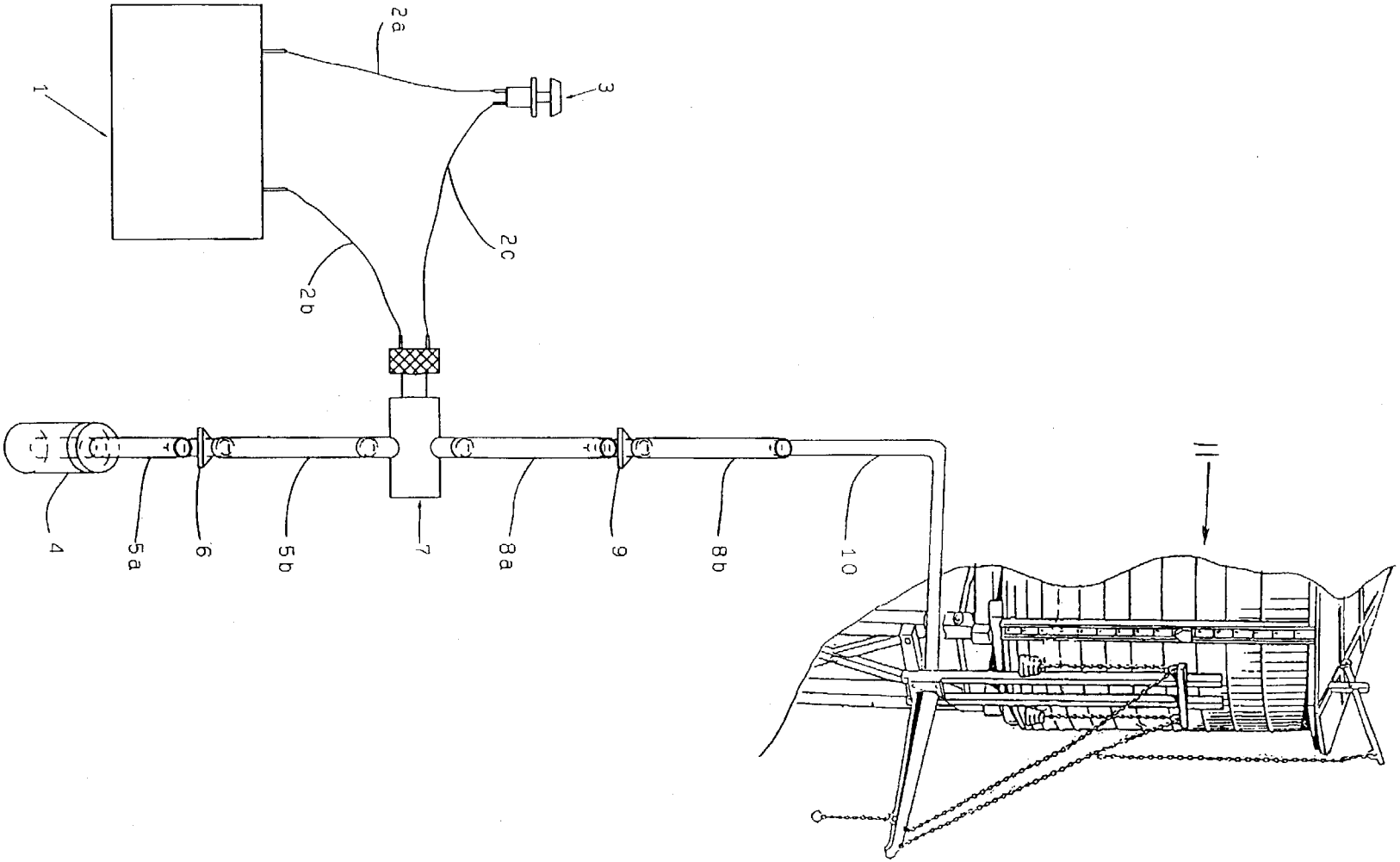
FIG. 4 is the pump system installed into a water tower used in model railroading.

In FIG. 4, is a sectional view of a water tower 11 used in model railroading with the complete pump system installed. A hollow metal tube 10 is located in the spout of the water tower. The metal tube 10 is bent at a 90 degree angle which is positioned in downward direction and located in the middle of the water tower stand to ensure that the tube is hidden from sight. A electrical push button assembly can be mounted close to the water tower for ease of operation. The hoses 8*a*, 8*b*, 5*a*, 5*b*, connectors 9, 6, piston pump assembly 7, power source 1, and wires 2*a*, 2*b*, 2*c*, can be mounted underneath the water tower. This adds to the realism and simulates actual operating water tower without showing the parts of the pump system.

ASSEMBLY AND OPERATION OF THE PUMP SYSTEM

The pump system comprises of simple parts to be assembled as shown in FIG. 2. These parts will be assembled in the following manner.

In FIG. 2 the electrical parts are the power source 1 which will hold a direct current power supply. Located on the power source 1 are two terminals, a positive and a negative pole for adjoining electrical wires. Wire 2*a* at one end is connected to the positive pole on the power source and the other end to the pole of the push button assembly 3. The push button assembly 7 is for completing and stopping the electrical current to the piston pump assembly 7. The push button 3 can be mounted on the railroad layout for ease of operation. The wire 2*c* at one end is connected to the other terminal of the push button 3 and the other end to the terminal on the electrical body of the pump assembly 7. Wire 2*b* is connected to the other terminals on the pump assembly 7 and the power source 1. This completes the electrical wiring of the pump system.

The mechanical parts will be assembled as follows: In FIG. 2 the reservoir 4 will store the liquid smoke and hold the hose 5*a* which will be installed in the top of the reservoir 4. The connector 6 will adjoin hose 5*a* to 5*b* by simply pushing the ends of each hose 5*a*, and 5*b* over the barbed ends of the plastic connector 6. The other end of hose 5*b* will be connected to the pump assembly 7 by contact cement. This will complete the suction side of the pump assembly. The hose 8*a* at one end will be connected to the pump assembly 7 by contact cement, and the other end of the hose 8*a* will be connected to the plastic connector 9 which will adjoin hose 8*b*. The other end of hose 8*b* will be connected to the hollow metal tube 10 by simply pushing the end over the tube 10. This will complete the pressure side of the pump assembly. The pump system is now completely assembled and ready to be installed into any structure on any model railroad layout. In FIG. 4 the pump system is assembled into a water tower structure.

The operation of the pump system will operate as follows:

In FIG. 4 the pump system will start by completing the electrical circuit by depressing the push button 3 which will allow the current to flow from the power source 1 through the push button 3 which will activate the electrical piston pump 7. The pump 7 while running will pick up the liquid smoke stored in the reservoir 4. The liquid smoke will travel trough hose 5*a*, connector 6 and hose 5*b*. The liquid smoke will enter the piston pump on the suction side and exit on the pressure side of the pump 7. The liquid smoke will travel through hose 8*a*, connector 9, hose 8*b* and drip out of the hollow metal tube 10. A few drops of liquid smoke is only needed for most smoking engines.

BACKGROUND OF THE INVENTION

This pump system improves the application of applying liquid smoke to steam engines or structures in all scales of model railroading. When liquid smoke is applied to the engine or structure that has a heater element, smoke is generated which simulates actual smoke. This pump system comprises of simple parts to be assembled and modified to fit into a model railroad structure. The pump system is to be installed into any structure in model railroading, such as a water tower or a factory smoke stack.

U.S. Pat. No. 5,158,210 to Benjamin R. Du has a similar art device which described for a condiment dispensing device. This system is similar in principal that incorporates such parts as: a reservoir, a pump, hoses, and nozzle. This system dispenses fluid by pushing a button which a pump, pumps fluid from a reservoir through hoses but has multiples of pumps, hoses, reservoirs with a hand-held apparatus for dispensing.

Currently, adding oil to an engine's smoke stack involves taking a hollow steel needle and puncturing a small plastic tube full of oil. The needle acts as a funnel to drip oil from the plastic tube into the smoke stack by applying pressure to the plastic tube using your hands. A hobbyist would apply the oil using this hand held tube and a needle to apply liquid smoke which always leaks and is impractical for everyday use. The hand held tube and needle method is very messy with oil getting on your hands and fingers. Before the above described system in model railroading, no system has used a pump system to apply liquid smoke to steam engines or structures. This pump system will eliminate using a hand held tube and needle to apply liquid smoke to the smoke stacks of smoking engines or smoking chimneys.

SUMMARY OF THE INVENTION

The pump system is to be installed into any structure in all scales of model railroading. The pump system can be installed into such structures as a water tower, or a factory chimney that can use the liquid smoke. This pump system will apply liquid smoke to the heater element in the smoke stacks located in the steam engines or chimney stacks. The simulation of real smoke will enhance any model railroad layout. The advantage of the pump system is that;

- it will eliminate the manual operation of applying liquid smoke;
- it will add realism to any model railroad layout;
- it provides an actual simulation for smoking engines to add smoke to it's smoke stack;
- it provides an on demand supply of liquid smoke on the railroad layout;
- it provides an ease of operation to apply liquid smoke to a chimney's structure;
- it is easy to install into any structure for all scales of model railroading.

Although the description above contains many specifications, these should not be construed as limiting the scope of this pump system. For example, the pump system can pump water to use as source for a waterfall, a river or stream, for fire trucks to simulate water for the fire hose, etc.

Thus the scope of this pump system should be determined by the appended claims, rather than the examples given.

I claim:

1. A system for dispensing liquid smoke into a model railroad engine comprising:

a model railroad system;

a reservoir sized to contain a quantity of liquid therein;

a rigid tube for dispensing;

a electrical driven pump coupled between said reservoir and said rigid tube for pumping liquid from said reservoir to said tube to draw a pre-determined quantity of liquid from the reservoir through the tube;

a electrical power source to drive said pump by means of electrical wires; and a push button assembly oriented in a manner to open and close said power source to activate said electrical pump through said wires; and at least two fluid passages in fluid communication with said pump; said fluid passages oriented between said pump and said reservoir and said rigid tube to draw liquid from the reservoir through the rigid tube by means of said electrical power activated by said push button to draw the pre-determined quantity of liquid.

* * * * *